US009504310B2

(12) United States Patent
Foreman

(10) Patent No.: US 9,504,310 B2
(45) Date of Patent: Nov. 29, 2016

(54) SUPPORT STRAP DISPENSERS AND HOLSTERS FOR USE WITH SAME

(71) Applicant: Marc Franklin Foreman, Woodland Hills, CA (US)

(72) Inventor: Marc Franklin Foreman, Woodland Hills, CA (US)

( * ) Notice: Subject to any disclaimer, the term of this patent is extended or adjusted under 35 U.S.C. 154(b) by 80 days.

(21) Appl. No.: 14/659,007

(22) Filed: Mar. 16, 2015

(65) Prior Publication Data

US 2015/0265037 A1 Sep. 24, 2015

Related U.S. Application Data

(60) Provisional application No. 61/969,116, filed on Mar. 22, 2014.

(51) Int. Cl.

| | |
|---|---|
| ***A45F 5/02*** | (2006.01) |
| ***B65H 49/00*** | (2006.01) |
| ***B65H 16/00*** | (2006.01) |
| ***B65H 49/20*** | (2006.01) |

(52) U.S. Cl.

CPC ..... *A45F 5/021* (2013.01); *B65H 16/005* (2013.01); *B65H 49/205* (2013.01); *A45F 2200/0575* (2013.01); *B65H 2301/5121* (2013.01); *B65H 2404/6111* (2013.01); *B65H 2701/11332* (2013.01); *B65H 2701/173* (2013.01); *B65H 2701/37* (2013.01); *Y10S 224/904* (2013.01)

(58) Field of Classification Search

CPC ..... A45F 5/021; A45F 2200/0575; B65H 49/205; B65H 35/0026; Y10S 224/904

USPC ..... 224/904, 242, 245, 243, 919

See application file for complete search history.

(56) References Cited

U.S. PATENT DOCUMENTS

| | | | | | |
|---|---|---|---|---|---|
| 1,818,514 | A | * | 8/1931 | Whitaker | B65H 75/22 224/162 |
| 1,990,135 | A | * | 2/1935 | Sato | B65H 49/205 224/162 |
| 2,765,107 | A | * | 10/1956 | Browning | F41C 33/0245 224/255 |
| D184,805 | S | * | 4/1959 | Evans | 224/163 |
| D193,678 | S | * | 9/1962 | Goldman | 224/163 |
| D196,542 | S | * | 10/1963 | Zelnick | 224/163 |
| 3,107,028 | A | * | 10/1963 | De Robertis | A47G 23/0216 215/395 |
| 3,217,955 | A | * | 11/1965 | Tinkey | B65H 35/002 225/47 |
| 3,589,634 | A | * | 6/1971 | Mason | B65H 16/005 242/422.4 |
| D227,823 | S | * | 7/1973 | Boyce | 224/162 |
| 3,777,953 | A | * | 12/1973 | Lewis | A45C 11/10 224/152 |
| 4,088,276 | A | * | 5/1978 | Littleton | B65H 16/005 225/46 |
| 4,195,794 | A | * | 4/1980 | Ricci | B65H 49/26 242/396.9 |
| 4,339,120 | A | * | 7/1982 | Czarny | A63J 21/00 224/919 |
| 4,562,620 | A | * | 1/1986 | Oliver, Jr. | A44B 11/005 224/163 |

(Continued)

*Primary Examiner* — Justin Larson

(74) *Attorney, Agent, or Firm* — Henricks, Slavin & Holmes LLP

(57) ABSTRACT

A dispenser for storing and dispensing a rolled support strap, including but not limited to hanger straps (sometimes referred to as "plumber's tape") such as those sold under the trade name TAB TAPE®, as well as assemblies that include a dispenser and a rolled support strap therein, and associated methods. A holster for holding the dispenser, as well as a system including a holster and a dispenser, are also disclosed.

18 Claims, 10 Drawing Sheets

(56) References Cited

U.S. PATENT DOCUMENTS

D283,076 S * 3/1986 States, Jr. ..... 224/247
4,596,370 A * 6/1986 Adkins ..... B62J 11/00 224/414
4,598,027 A * 7/1986 Johnson ..... A45F 5/02 156/212
4,606,485 A * 8/1986 Rankin ..... B65H 35/0006 225/66
4,821,933 A * 4/1989 Seber ..... A45F 5/02 224/248
4,844,373 A * 7/1989 Fike, Sr. ..... A47F 13/04 206/389
4,852,843 A * 8/1989 Chandler ..... B60N 3/103 220/737
5,012,965 A * 5/1991 Miller ..... F41C 33/0209 224/230
5,025,966 A * 6/1991 Potter ..... A45F 5/02 224/183
5,097,997 A * 3/1992 Kipnis ..... A44B 99/00 224/195
5,167,355 A * 12/1992 Hill ..... A45F 5/00 224/193
5,358,160 A * 10/1994 Bianchi ..... A45F 3/14 224/192
5,388,741 A * 2/1995 Hillinger ..... A45F 5/02 206/349
5,641,109 A * 6/1997 Willoughby ..... B65H 35/0026 224/162
D390,699 S * 2/1998 Goldenberg ..... D3/218
5,749,507 A * 5/1998 Wood ..... F41A 23/18 224/255
5,806,739 A * 9/1998 Wood ..... F41A 23/18 211/64
6,095,455 A * 8/2000 Green ..... A45F 5/02 24/3.12
6,193,119 B1 * 2/2001 Schwarm ..... A45F 5/021 224/197
6,193,120 B1 * 2/2001 Chang ..... A63B 47/001 206/315.9
6,457,252 B1 * 10/2002 Kershner ..... G01B 3/1071 33/755
D468,525 S * 1/2003 Boyle ..... D3/218
D483,939 S * 12/2003 Kountz ..... D3/215
6,824,028 B2 * 11/2004 Mutai ..... A45F 5/02 224/269
7,077,184 B2 * 7/2006 Mertins, Jr. ..... B65H 35/0026 156/510
D548,957 S * 8/2007 Lowe ..... D27/186
D559,531 S * 1/2008 Koppe ..... D27/186
D574,837 S * 8/2008 Hooks, Jr. ..... D14/453
D583,989 S * 12/2008 Khubani ..... D26/138
D600,006 S * 9/2009 Lau ..... D27/186
8,479,960 B2 * 7/2013 Lopez-Apodaca . B60R 11/0241 224/312
8,616,422 B2 * 12/2013 Adelman ..... A45F 5/00 224/191
D710,340 S * 8/2014 Wengreen ..... D14/238.1
D710,363 S * 8/2014 Wengreen ..... D14/432
9,033,197 B2 * 5/2015 Bar ..... A45F 5/02 224/162
9,170,082 B2 * 10/2015 Moreau ..... G01B 3/1041
9,182,205 B2 * 11/2015 Sitz ..... F41A 23/18
9,261,328 B2 * 2/2016 Sitz ..... F41A 23/18
D758,220 S * 6/2016 Votel ..... D10/74
2002/0113104 A1 * 8/2002 Levsen ..... A45F 5/021 224/233
2004/0004097 A1 * 1/2004 Seenauth ..... A63B 47/002 224/269
2012/0255979 A1 * 10/2012 Sitz ..... F41C 33/0245 224/243
2013/0327799 A1 * 12/2013 Sitz ..... F41C 33/0245 224/243
2014/0077023 A1 * 3/2014 Foreman ..... B65H 35/002 242/588.3
2015/0265037 A1 * 9/2015 Foreman ..... A45F 5/021 224/665
2016/0058161 A1 * 3/2016 Brennan ..... B65H 35/0026 224/162

* cited by examiner

SUPPORT STRAP DISPENSERS AND HOLSTERS FOR USE WITH SAME

CROSS-REFERENCE TO RELATED APPLICATIONS

This application claims the benefit of U.S. Provisional Application Ser. No. 61/969,116, filed Mar. 22, 2014 and entitled "Support Strap Dispensers And Holsters For Use With Same," which is incorporated herein by reference in its entirety.

BACKGROUND

1. Field

The present inventions relate generally to dispensers for support straps and to holsters for such support strap dispensers.

2. Related Art

Support straps are commonly used to secure mechanical and electrical building components, such as plumbing pipes, conduit, heating and air conditioning ducts, and water heaters, to building support structures or to suspend these components from building support structures. In the exemplary context of hanger straps (sometimes referred to as "plumber's tape"), a flexible strip of material, such as sheet metal (e.g., a 24 or 28 gauge strip of copper-plated steel or galvanized steel) or polypropylene, is attached at one end to a support member such as a beam, post, or wall stud. The other end of the strip is wrapped around the pipe or conduit and attached in some manner to the first end, thereby forming a loop which supports the conduit. Support straps will often include regularly spaced holes along the length of the strap, and some support straps include fasteners to facilitate the connection of one portion of the strap to another after the formation of the loop.

Support straps are commonly distributed in roll form. The length of the support strap in the roll is such that many individual straps will be cut from the roll. The installer will unroll a portion of the strap and remove it from the remainder with a metal cutting tool. Exemplary roll lengths include, but are not limited to, 10 feet, 25 feet and 50 feet. The support strap rolls are commonly held with one hand and cut with a tool held in the other hand during the unrolling and cutting process. The support strap rolls are also commonly stored within tool boxes or the like during periods of non-use. The present inventor has determined that conventional usage and storage methodologies associated with support strap rolls are susceptible to improvement. For example, the resiliency of the rolled support strap can cause the support strap to move as the user is trying to cut it. The thin metal material that forms the support strap may also have sharp side edges that can injure the user. The support strap roll may also unwind or be otherwise disfigured, and/or the support strap may be bent, when stored in a tool box.

The present inventor has also determined that it would desirable for a user to be able to remove support strap from a support strap dispenser without having to hold the support strap dispenser with one of his/her hands.

SUMMARY

A support strap dispenser in accordance with at least one of the present inventions includes a housing with an internal storage region and an outlet, and an apparatus, associated with housing, that is configured to frictionally engage the support strap to prevent unwanted movement of the support strap. The present inventions also include an assembly which has such a support strap dispenser and a support strap roll located therein. The present inventions also include methods of dispensing a support that include the steps of storing the support strap in rolled and frictionally engaging the support strap to prevent movement of the support strap relative to the outlet absent user-applied force.

A holster, for use with a support strap dispenser, in accordance with at least one of the present inventions includes a plurality of walls that define a storage region for the support strap dispenser and at least one outlet opening, which the dispenser outlet will be aligned with when the dispenser is in the storage region, and a retainer that maintains the dispenser in the storage region.

A system in accordance with at least one of the present inventions includes a support strap dispenser including a housing with an internal storage region configured to store a support strap roll and a dispenser outlet, and a holster including a plurality of walls that define a storage region for the support strap dispenser and at least one outlet opening, which the dispenser outlet will be aligned with when the support strap dispenser is in the storage region, and a retainer that maintains the support strap dispenser in the storage region.

BRIEF DESCRIPTION OF THE DRAWINGS

Detailed description of preferred embodiments of the inventions will be made with reference to the accompanying drawings.

DETAILED DESCRIPTION OF THE EXEMPLARY EMBODIMENTS

The following is a detailed description of the best presently known modes of carrying out the inventions. This description is not to be taken in a limiting sense, but is made merely for the purpose of illustrating the general principles of the inventions.

The present inventions include, but are not limited to, support strap dispensers, dispenser holsters and systems including support strap dispensers and dispenser holsters. Exemplary dispensers are discussed below with reference to FIGS. 1-16 and 21, exemplary holsters are discussed below with reference to FIGS. 17-20, and exemplary systems are discussed below with reference to FIGS. 22-27.

Figure 1:
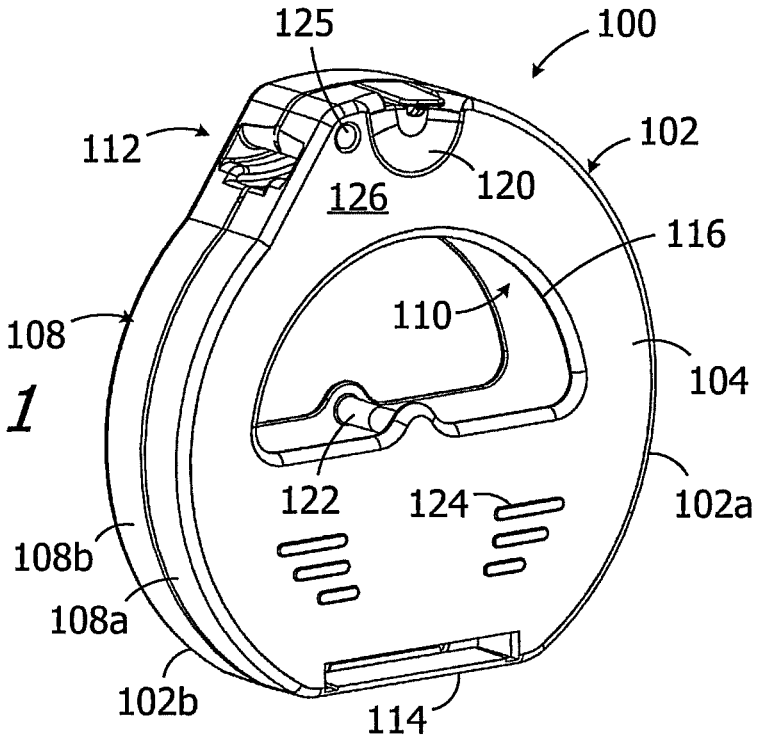
FIG. 1 is a perspective view of a support strap dispenser in accordance with one embodiment of a present invention.
Figure 2:
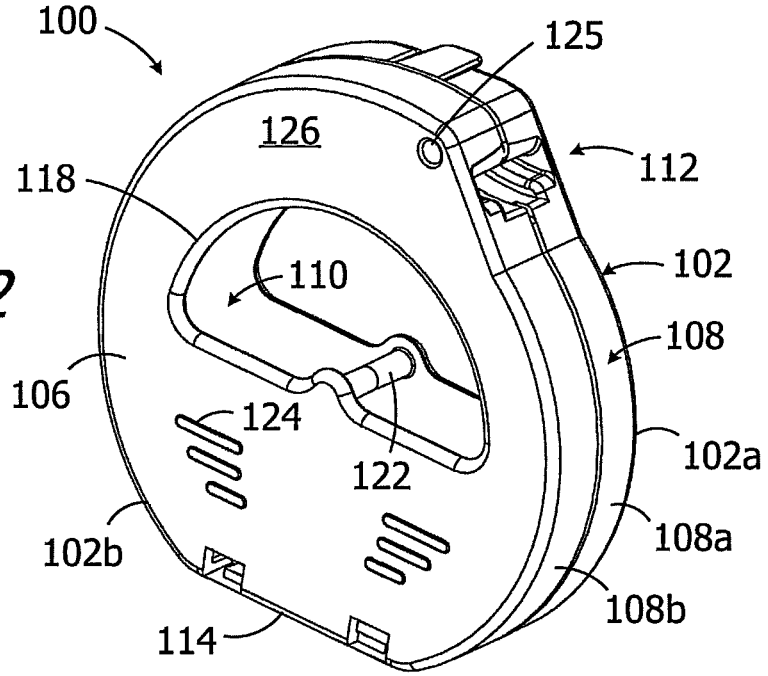
FIG. 2 is another perspective view of the support strap dispenser illustrated in FIG. 1.

As illustrated for example in FIGS. 1 and 2, the support strap dispenser 100 includes a housing 102 having end walls 104 and 106 and a side wall 108 therebetween. The housing 102 defines an interior storage region 110, in which a support strap roll can be stored and protected from damage, and an outlet 112 through which portions of the support strap may be pulled. The housing 102 may be provided with a flat surface 114 that allows the strap dispenser 100 to rest in an upright position on a floor, table or other flat support surface. Apertures 116 and 118, which extend through end walls 104 and 106, perform a number of functions. For example, the apertures 116 and 118 form a handle through which the user can place his fingers, with the thumb in the indentation 120, during use. Holding the strap dispenser 100 (with the support strap roll carried therein) reduces the likelihood that an edge of the support strap will injure the user, and also allows the other hand to hold a cutting tool. The apertures 116 and 118 also define windows that allow the user to see how much of the support strap roll (not shown here) remains within the support strap dispenser 100. A support member 122, which extends from end wall 104 to end wall 106, provides structural support to maintain the spacing between the walls and, in some instances, defines an axle for the support strap roll. Each wall 104 and 106 may also be provided with reinforcing members 124 that augment the structural integrity of the wall. The reinforcing members 124 may be located on the exterior surface (as shown), the interior surface, or both. The housing may also include aperture 125 for a D-ring or other structure that allows the support strap dispenser 100 to be connected to a tool belt or the like.

Although the present dispensers are not limited to any particular shape, the exemplary housing 102 illustrated in FIGS. 1 and 2 is generally disc-shaped. One end of the exemplary housing 102 has the flat surface 114, and the other end of the housing includes the outlet 112 and a dispenser head 126. During use, and as is explained in greater detail below with reference to FIGS. 7-10, the user pulls portions of the support strap stored within the dispenser 100 through the outlet 112 prior to cutting off the desired length of support strap. The dispenser head 126 fixes the position of the support strap when the support strap is not being pulled, thereby preventing inward and outward movement of the support strap.

The exemplary housing 102 is defined by a pair of housing members 102*a* and 102*b*. The housing members 102*a* and 102*b* may, in some instances, be partially or fully separable from one another in order to facilitate placement of the support strap roll into the storage region 110. The housing members 102*a* and 102*b* respectively include one of the end walls 104 and 106, and portions 108*a* and 108*b* of the side wall 108. In the illustrated implementation, the housing members 102*a* and 102*b* pivot relative to one another. A hinge about which the housing members 102*a* and 102*b* pivot is located adjacent to the flat surface 114, and a latch mechanism that locks the housing members 102*a* and 102*b* in the closed state illustrated in FIGS. 1 and 2 is located on the dispenser head 126. The respective locations of the hinge and latch, which are discussed in greater detail below with reference to FIGS. 3-6, may vary in other implementations.

Figure 3:
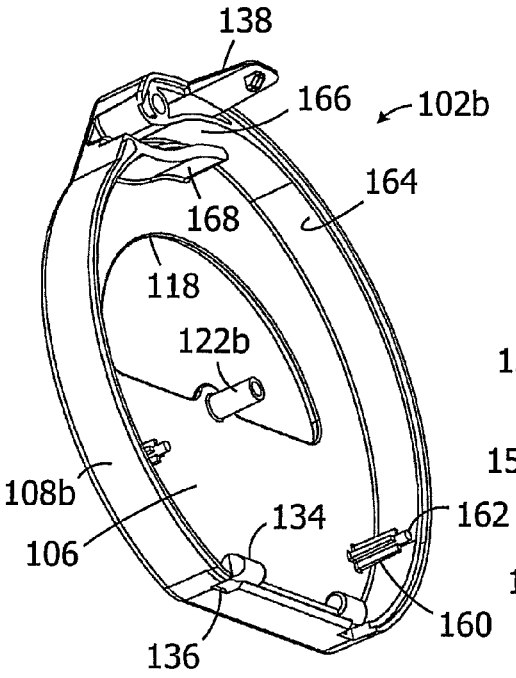
FIG. 3 is a perspective view of a portion of the support strap dispenser illustrated in FIG. 1.
Figure 4:
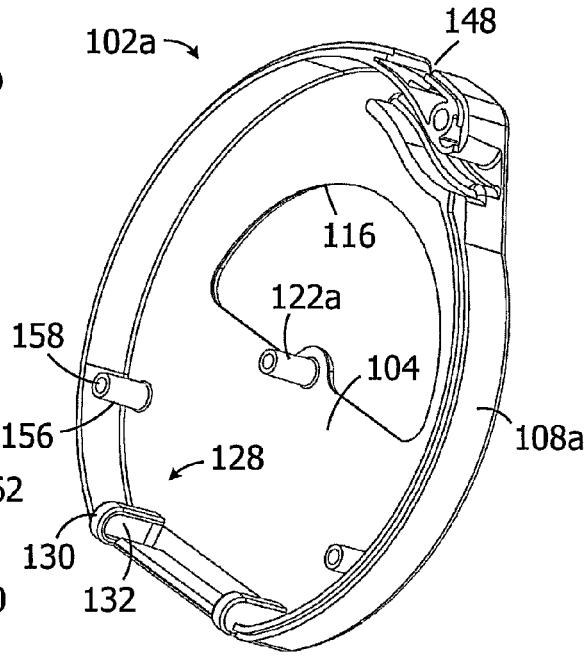
FIG. 4 is a perspective view of another portion of the support strap dispenser illustrated in FIG. 1.
Figure 5:
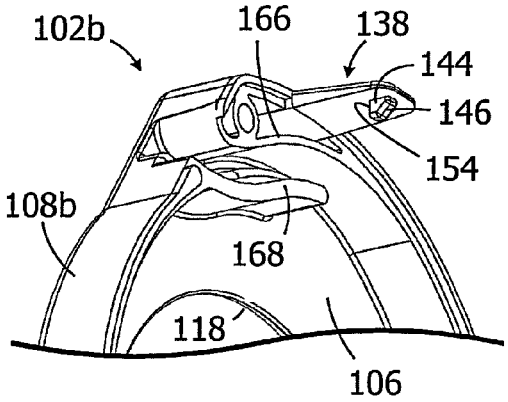
FIG. 5 is a perspective view of a portion of the support strap dispenser portion illustrated in FIG. 3.
Figure 6:
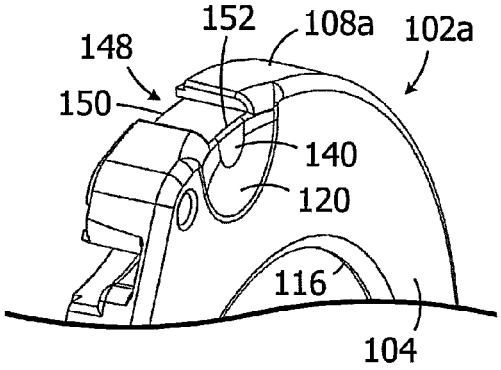
FIG. 6 is a perspective view of a portion of the support strap dispenser portion illustrated in FIG. 4.

Turning to FIGS. 3 and 4, the housing members 102*a* and 102*b* each include a portion of the hinge. In the illustrated arrangement, the housing member 102*a* includes a pair of arms 128 that have a wall 130 which defines an indentation 132. The housing member 102*b* has a corresponding pair of pins 134. The respective sizes and locations of the arms 128 and pins 134 are such that, when the housing members 102*a* and 102*b* are brought together, the arms will deflect slightly and the pins will snap into the semi-circular portion of the indentation 132. The housing member 102*b* is also provided with clearance slots 136 that the arms 128 move in to as the housing member 102*a* pivots away for the orientation illustrated in FIGS. 1 and 2 to the open position.

The exemplary support strap dispenser 100 is also configured to automatically lock when the housing members 102*a* and 102*b* pivot from the open position to the orientation illustrated in FIGS. 1 and 2. To that end, and referring to FIGS. 5 and 6, the exemplary latch includes latch member 138 that cooperates with a latch surface 140. The latch member 138, which is carried by the housing member 102*b* in the illustrated embodiment, has a deflectable beam 142 and a projection 144 with a cam surface 146. The projection 144 may extend laterally over a portion of the width of the beam 142 (as shown) or all the way across the beam. The latch surface 140 is formed on the housing member 102*b* adjacent to the indentation 120. The housing member 102*b* is also provided with a slot 148. As the housing members

102*a* and 102*b* are pivoted toward one another, the cam surface 146 will engage the edge 150 of the slot, thereby deflecting the beam 142. The projection 144 will then slide along the surface of the slot 148, as the beam 142 remains deflected, until the projection 144 reaches the edge 152 of the slot 148. The resilience of the beam 142 will then cause the flat surface 154 on the projection 144 to engage the latch surface 140.

The stiffness of the beam 140 will maintain the latch in the latched state until the beam is deflected (upwardly in the illustrated orientation) to such an extent the flat surface 154 on the projection 144 is free of the latch surface 140. This may be accomplished by, for example, placing a thumb in the recess 120 and then pushing the latch member 138. The housing members 102*a* and 102*b* can then be separated by pivoting them about the aforementioned hinge.

It should be noted here that the present dispensers are not limited to any particular hinge or latch arrangement. For example, the hinge may be omitted and two separable housing members may be provided that can be attached and detached as necessary.

The housing 102 may also be provided with various alignment and support features. In the illustrated implementation, and referring to FIGS. 3 and 4, housing portion 102*a* includes a pair of posts 156 with pin receptacles 158 and housing portion 102*b* includes a pair of posts 160 with pins 162. The posts 156 and 160 are sized and positioned such that the pins 162 will be located within the pin receptacles 158 when the housing 102 is in the closed state illustrated in FIGS. 1 and 2. The support member 122 is defined by a pair of support member portions 122*a* and 122*b* that abut one another when the housing 102 is in the closed state. The number and location of such alignment and support features may differ in other implementations.

When a support strap roll is placed into the storage region 110, the outer portion of the roll will be located radially inward of the posts 156 and 160 and the lower guide 168 (discussed below) but for the portion of the support strap roll that has entered the dispenser head 126. In many instances, the portion of the support strap roll that is approaching the dispenser head will rest against the inner surface 164 (FIG. 3) of the side wall 108.

Figure 7:
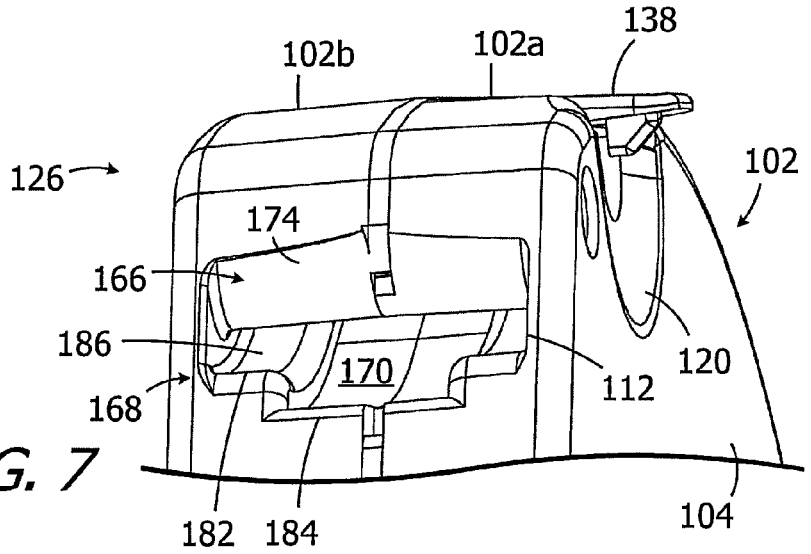
FIG. 7 is a perspective view of a dispenser head in accordance with one embodiment of a present invention.
Figure 8:
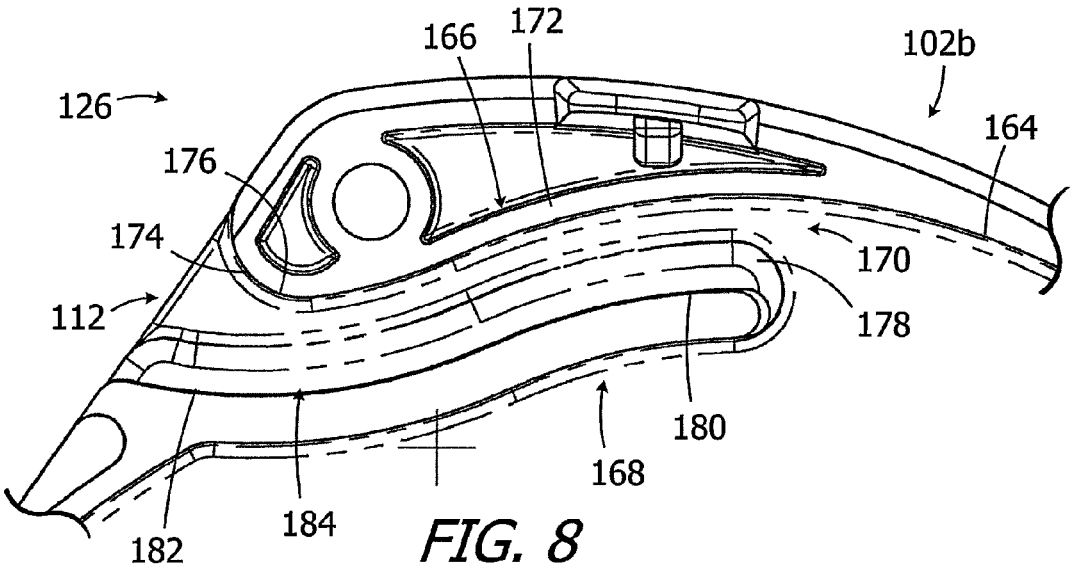
FIG. 8 is a side view of a portion of the dispenser head illustrated in FIG. 7.

Turning to FIGS. 7 and 8, the exemplary dispenser head 126 includes an upper guide (or "first guide") 166, a lower guide (or "second guide") 168 and a gap 170 therebetween. The housing portions 102*a* and 102*b* include identical mirror image portions of the upper guide 166, lower guide 168 and gap 170, and the discussion below is applicable to both housing portions. The support strap passes through the gap 170 on its way to the outlet 112, and the frictional forces between the support strap and portions of the upper guide 166 and lower guide 168 prevent unwanted movement of the support strap relative to the dispenser head 126. The upper guide 166, lower guide 168 and gap 170 in the illustrated implementation undulate over their respective lengths. In particular, the upper guide 166 includes a surface with a convex region 172, a concave region 174 and an apex 176 between the two. In the illustrated embodiment, the side wall inner surface 164 and the upper guide convex region 172 together define a smooth, continuous surface. As discussed below with reference to FIG. 9, the apex 176 applies a friction-generating force to the support strap that bends the support strap. The lower guide 168 includes an end 178, which defines the pickup (or entry) point where the support strap enters the dispenser head 126 as well as a convex region 180 and a concave region 182. The lower guide end 178 also applies a friction-generating force to the support strap.

In some implementations, including the illustrated implementation, the lower guide 168 may also have a recess 184 that accommodates protrusions that may be found on some support straps (e.g., the support strap illustrated in U.S. Pat. No. 5,522,571 and sold under the trade name TAB TAPE®). As a result, the exemplary lower guide 168 has a pair of spaced guide surfaces (or rails) 186 that are separated by the recess 184.

The materials and size of the dispenser 100 will depend on the intended usage. Suitable materials include, but are not limited to, thermoplastic polymers such as polypropylene. A dispenser 100 that is configured for 26-28 gauge support strap rolls that range from 10 to 25 feet in length (unrolled) may be about 5 to 6 inches in height and width. The thickness will depend on the width of the intended support strap.

Figure 9:
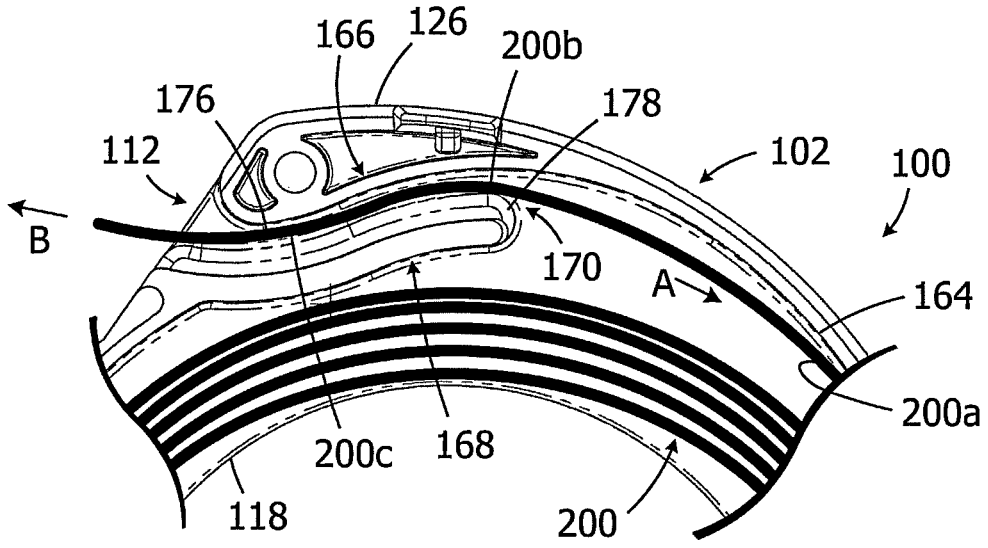
FIG. 9 is a side view of the support strap dispenser illustrated in FIGS. 1-8 with a support strap roll located therein and a portion of the dispenser housing removed so that the interior is visible.
Figure 10:
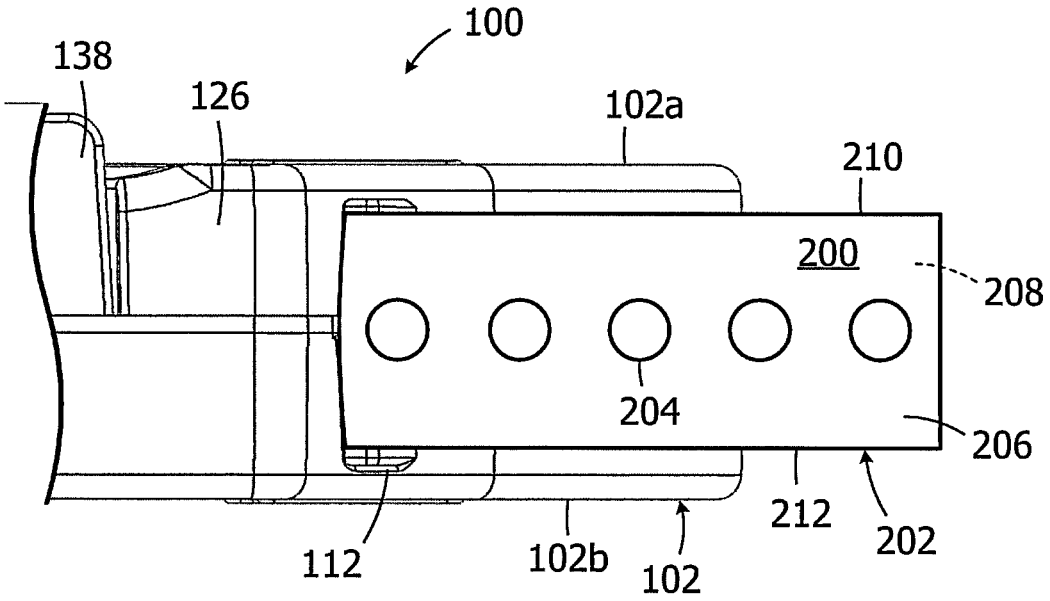
FIG. 10 is a top view of a portion of the support strap dispenser illustrated in FIGS. 1-8 with a support strap roll located therein and a portion of the support strap extending through the dispenser outlet.

FIGS. 9 and 10 show the exemplary support strap dispenser 100 with a rolled support strap 200 carried therein. Although the present inventions are not limited to any particular support straps, the exemplary support strap 200 includes a main body 202 and a plurality of apertures 204. The main body 202 has a top surface 206, a bottom surface 208 and side edges 210 and 212. Suitable support strap materials include, but are not limited to, copper, galvanized steel and polypropylene, that is about 0.75 to 1.5 inch wide and about 0.016 inch to about 0.013 inch thick (i.e. about 26-28 gauge).

The support strap 200 is wound into a spiral roll, with the radially outermost portion 200*a* entering the dispenser head 126 by way of the gap 170. As a result of being wound into a spiral roll, the support strap 200 defines a first curvature. The magnitude of the first curvature may vary over the length of the support strap and may even be zero (i.e. support strap 200 may be straight) just prior to entering the gap 170 at the lower guide end 178. The lower guide end 178 and support strap portion 200*b* engage one another with enough force, in a direction generally perpendicular to support strap portion 200*b*, to bend the support strap 200 at the point of engagement into a second curvature. As a result, there is a friction force between the lower guide end 178 and support strap portion 200*b* that resists outward and inward movement (note arrows A and B) of the support strap 200 relative to the dispenser head 126. The relative thicknesses of the gap 170 and support strap 200, and the undulating shape of the upper guide 166 and the lower guide 168, results in the support strap being spaced apart from (and out of contact with) the upper guide and the lower guide between the upper guide apex 176 and the lower guide end 178. The upper guide apex 176 and support strap portion 200*c* engage one another with enough force, in a direction generally perpendicular to strap portion 200*c*, to bend the support strap 200 at the point of engagement into a third curvature. The second and third curvatures are in different directions in the illustrated embodiment, and may be of the same magnitude or different magnitudes. A friction force is created between the upper guide apex 176 and support strap portion 200*c* that also resists outward and inward movement of the support strap 200 relative to the dispenser head 126. It should also be noted that friction force is applied to both the top and bottom surfaces 206 and 208 of the strap main body 202.

The combined magnitude of the friction forces between the dispenser head 126 and the support strap 200 is large enough to prevent unwanted movement of the support strap in or out of the dispenser 100. The rolled support strap 200 may, for example, store potential energy that is created when the support strap is rolled, when the support strap is placed into the dispenser 100, and/or when a portion of the support strap is pulled through the outlet 112 by the user. Absent the friction force, the support strap 200 could move after the user has pulled the desired length support strap through the outlet 112, released the end of the support strap, and is holding the dispenser 100 with one hand and a cutting tool with the other. The overall friction force should not, however, be so high that it precludes the user from pulling the support strap through the outlet 112.

The friction force may also be adjusted in a variety of ways. For example, the thickness of the gap 170 (or a portion thereof) may be reduced to a thickness substantially equal to the thickness of the support strap 200, thereby increasing the amount of dispenser head/support strap contact. The upper guide 166 and/or the lower guide 168 may also be reconfigured such that the bending of the support strap is more or less severe and/or occurs at additional or fewer points along the support strap. The smooth, undulating curvatures of the upper guide 166 and/or the lower guide 168 may be replaced with sharper corners and more abrupt changes in direction. Surface roughening may also be employed. Additionally, or alternatively, friction generating forces may be applied to the side edges 210 and 212 of the support strap 200 to control its position within the dispenser head 126.

It should also be noted that the first and second guides 166 and 168 may be reoriented from their illustrated upper/lower orientation. For example, there may be instances where the portion of the support strap 200 within the dispenser head 126 is rotated to some extent from its illustrated orientation (e.g., ninety degrees) about its longitudinal axis. Here, the first and second guides would be correspondingly rotated and, therefore, could be referred to as "right" and "left" guides, or simply "side," guides.

Figure 11:
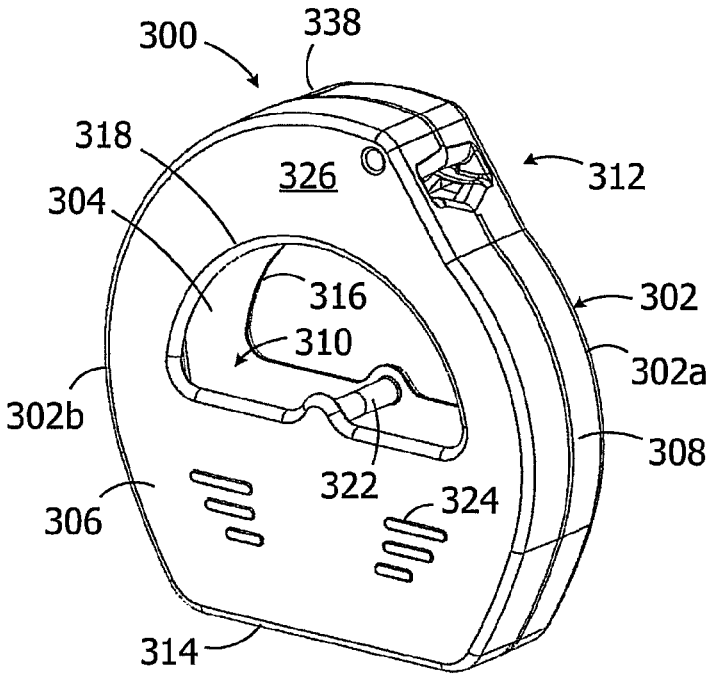
FIG. 11 is a perspective view of a support strap dispenser in accordance with one embodiment of a present invention.

Another exemplary support strap dispenser is generally represented by reference numeral 300 in FIG. 11. Support strap dispenser 300 is essentially identical to support strap dispenser 100 in structure, function, materials and operating methodology, and similar elements are represented by similar reference numerals. For example, support strap dispenser 300 includes a housing 302 having end walls 304 and 306 and a side wall 308 therebetween. The housing 302 defines an interior storage region 310, in which a support strap roll can be stored and protected from damage, and an outlet 312 through which portions of the support strap may be pulled. The housing 302 is also provided with a flat surface 314 that is discussed in greater detail below with reference to FIGS. 14-16. Apertures 316 and 318, which extend through end walls 304 and 306, form a handle and define windows in the manner described above. A support member 322 is also provided, as are reinforcing members 324 on each wall 304 and 306.

Figure 14:
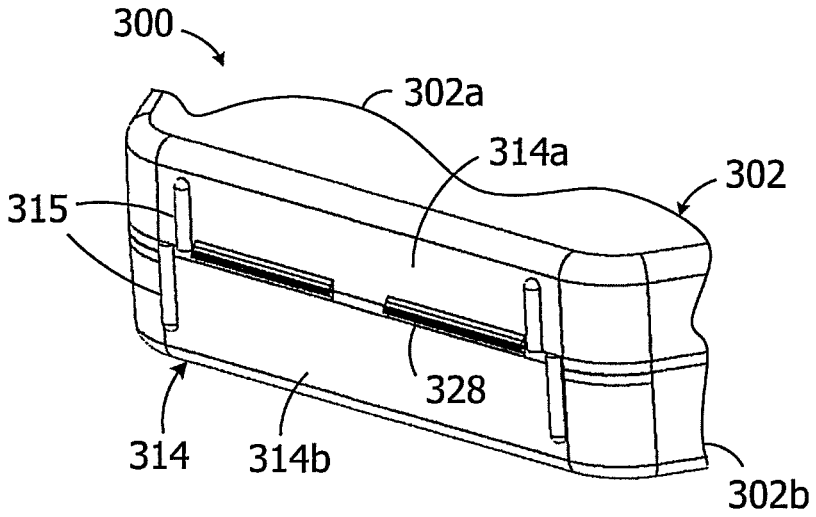
FIG. 14 is a perspective view of a portion of the support strap dispenser portion illustrated in FIG. 11.
Figure 15:
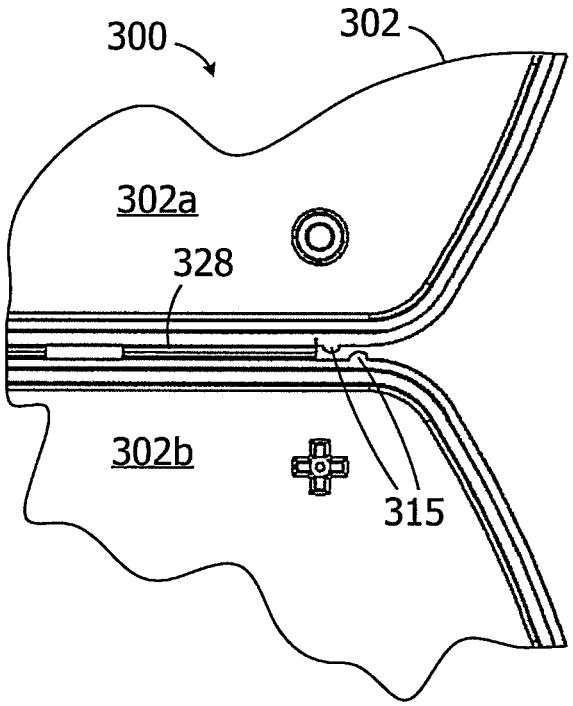
FIG. 15 is a plan view of a portion of the support strap dispenser portion illustrated in FIG. 11 in an open state.
Figure 16:
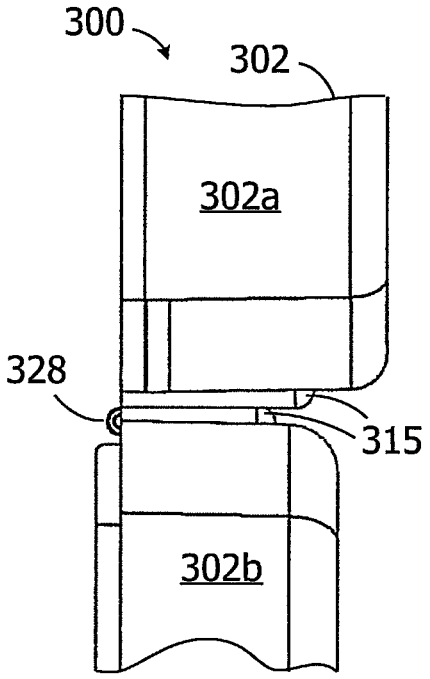
FIG. 16 is a side view of a portion of the support strap dispenser portion illustrated in FIG. 11 in an open state.
Figure 17:
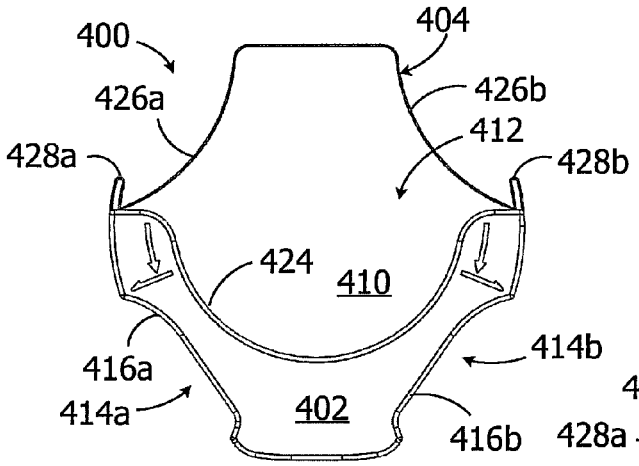
FIG. 17 is a front view of a holster in accordance with one embodiment of a present invention.
Figure 18:
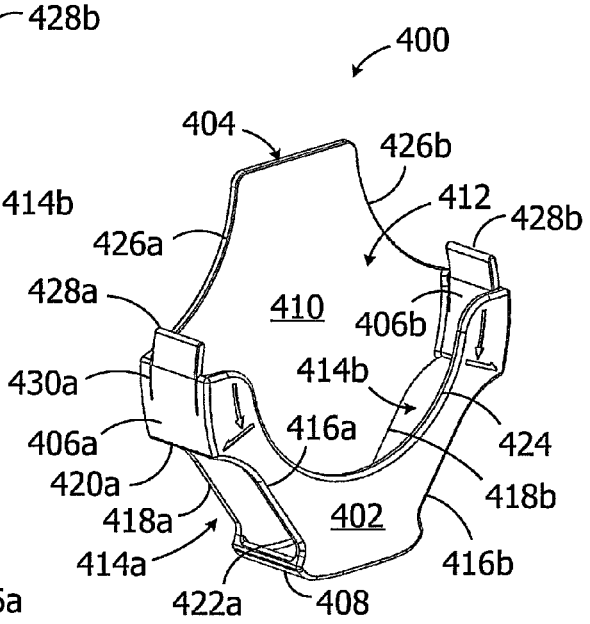
FIG. 18 is a perspective view of the holster illustrated in FIG. 17.
Figure 19:
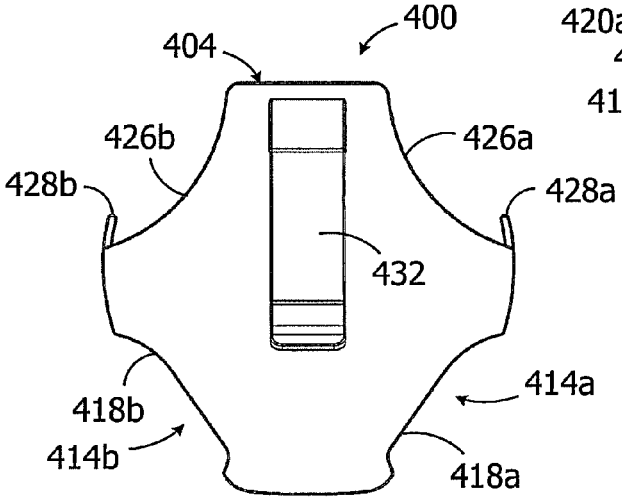
FIG. 19 is a rear view of the holster illustrated in FIG. 17.
Figure 20:
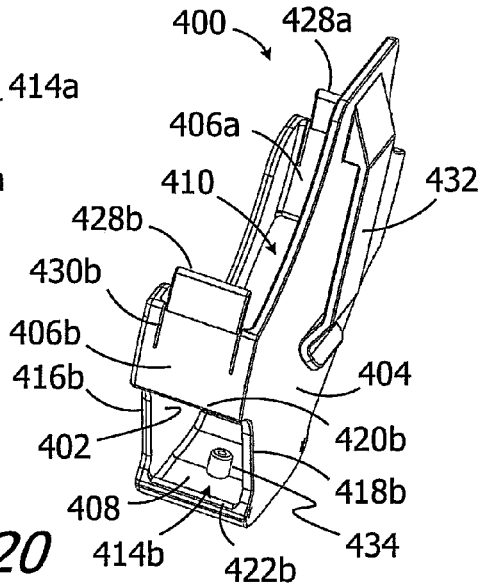
FIG. 20 is a perspective view of the holster illustrated in FIG. 17.

The exemplary housing 302 is defined by a pair of housing members 302*a* and 302*b* that pivot relative to one another about a hinge 328 (FIGS. 14-16). A latch mechanism, including exemplary latch member 338, that locks the housing members 302*a* and 302*b* in the closed state illustrated in FIGS. 11 and 12 may be located on the dispenser head 326. The location of the latch member 338 is offset from the location of latch member 128 in dispenser 100.

Figure 12:
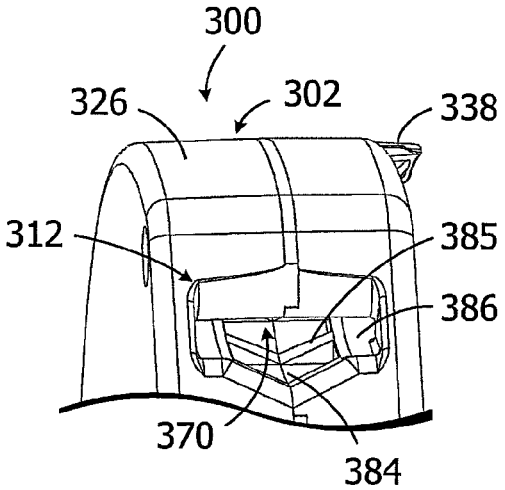
FIG. 12 is an enlarged perspective view of a portion of the support strap dispenser portion illustrated in FIG. 11.
Figure 13:
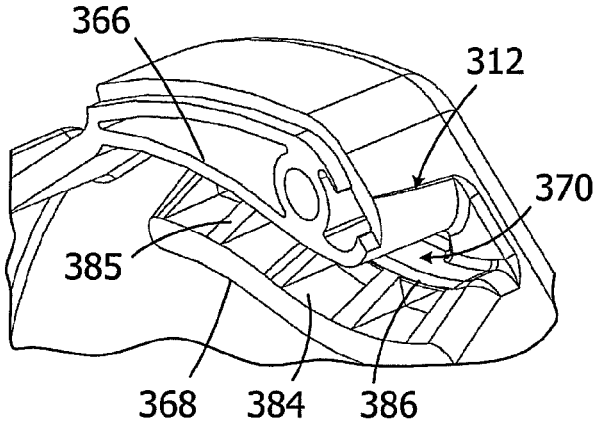
FIG. 13 is a perspective view of a portion of the support strap dispenser portion illustrated in FIG. 11.

Turning to FIGS. 12 and 13, the exemplary support strap dispenser 300 also includes a dispenser head 326 that fixes the position of the support strap when the support strap is not being pulled by the user, thereby preventing inward and outward movement of the support strap. Like the dispenser head 126, the dispenser head 326 includes an upper guide (or "first guide") 366, a lower guide (or "second guide") 368 and a gap 370 therebetween, each of which undulate over their respective lengths. The support strap passes through the gap 370 on its way to the outlet 312, and the frictional forces between the support strap and portions of the upper guide 366 and lower guide 368 prevent unwanted movement of the support strap relative to the dispenser head 326 in the manner described above. The lower guide 368 in the illustrated implementation also has a recess 384 that accommodates protrusions that may be found on some support straps and a pair of spaced guide surfaces (or rails) 386 that are separated by the recess 384. Here, however, a plurality of triangular structures 385 are located within the recess 384 and are longitudinally spaced along the gap 380. The triangular structures 385 facilitate loading the support strap (e.g., support strap 200 in FIGS. 9 and 10) into the dispenser 300. In particular, the triangular structures 385 guide one of the support strap side edges (e.g., side edge 210 or 212) onto one of the guide surfaces 386 as the support strap placed into one of the housing members 302*a* and 302*b* when the dispenser 300 is in an open, and guide the other support strap side edge onto the other guide surface as the housing members are brought together to close the dispenser.

As illustrated for example in FIGS. 14-16, the housing flat surface 314 is formed from flat portions 314*a* and 314*b* on housing members 302*a* and 302*b*. Each flat portion 314*a* and 314*b* includes a pair of protrusions 315 that support the dispenser 300 when it is placed in an upright position on a floor, table or other flat support surface. The flat portions 314*a* and 314*b* also serve as the location at which the housing members 302*a* and 302*b* are pivotably connected to one another. To that end, one or more hinges (e.g., living hinges) 328 connect the housing members 302*a* and 302*b* to one another at the flat portions 314*a* and 314*b*.

One example of a holster for a support strap dispenser is generally represented by reference numeral 400 in FIGS. 17-20. The exemplary holster 400 includes front and rear walls 402 and 404 that are connected to one another by side walls 406*a* and 406*b* and by a bottom wall 408. The walls 402-408 together define a dispenser storage region 410, a dispenser insertion/removal opening 412, and a pair of outlet openings 414*a* and 414*b*. Depending upon the orientation of the dispenser, the dispenser outlet will be located in one of the outlet openings 414*a* and 414*b* when the dispenser is fully inserted into the storage region 410. The outlet openings 414*a* and 414*b* are defined by wall edges 416*a*-422*a* and wall edges 416*b*-422*b*. The front wall 402 also has an edge 424 that aligns with the dispenser aperture when the dispenser in the storage region 410, as is discussed below with reference to FIG. 22, while the rear wall 404 has curved upper edges 426*a* and 426*b*.

The exemplary holster 400 illustrated in FIGS. 17-20 may also include one or more retainer mechanisms that hold the dispenser in the storage region 410. In the illustrated implementation, movable tabs 428*a* and 428*b* are carried by the side walls 406*a* and 406*b* and are biased to the position illustrated in FIGS. 17-20. The tabs 428*a* and 428*b* are separated from the coextensive portions of the side walls 406*a* and 406*b* by slots 430*a* and 430*b*. As such, the exemplary tabs 428*a* and 428*b* move by pivoting about the ends that are secured to the side walls 406*a* and 406*b* as a dispenser is moved in and out of the storage region 410, and through the insertion/removal opening 412, by the user in the manner described below with reference to FIG. 22.

The exemplary holster 400 illustrated in FIGS. 17-20 may also include one or more retainer mechanisms that mount the dispenser on the user. In the illustrated implementation, the holster 400 includes a resilient clip 432 that may be used to mount the holster on, for example, a belt, tool belt, or a pant waist. The resilient clip 432 may be formed as an integral part of the holster 400, or formed separately and attached to the holster.

The materials and size of the holster 400 will depend on the intended usage and the size of the associated dispenser. Suitable materials include, but are not limited to, thermoplastic polymers such as polypropylene.

Figure 21:
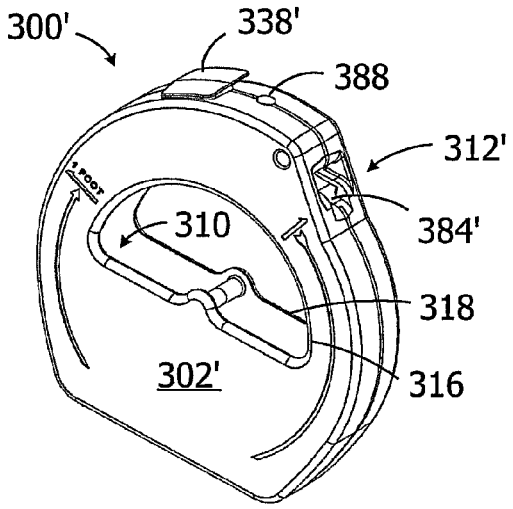
FIG. 21 is a perspective view of a support strap dispenser in accordance with one embodiment of a present invention.

One example of a support strap dispenser that may be used in conjunction with the holster 400 is generally represented by reference numeral 300' in FIG. 21. Support strap dispenser 300' is essentially identical to support strap dispenser 300 in structure, function, materials and operating methodology, and similar elements are represented by similar reference numerals. For example, support strap dispenser 300' includes a housing 302' that defines an interior storage region 310, in which a support strap roll can be stored and protected from damage, and an outlet 312' through which portions of the support strap may be pulled. The interior storage region 310 is visible by way of apertures 316 and 318. The outlet 312' has a recess 384' that is slightly deeper than recess 384 (FIG. 12), and the latch 338' is slightly thicker than latch 338 (FIG. 12).

Figure 23:
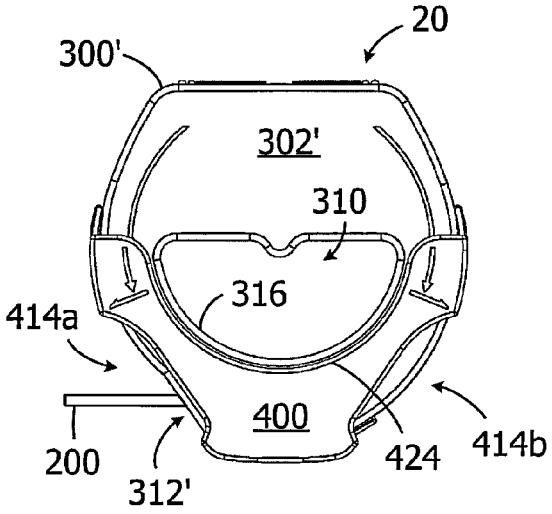
FIG. 23 is a front view of the system illustrated in FIG. 22.
Figure 22:
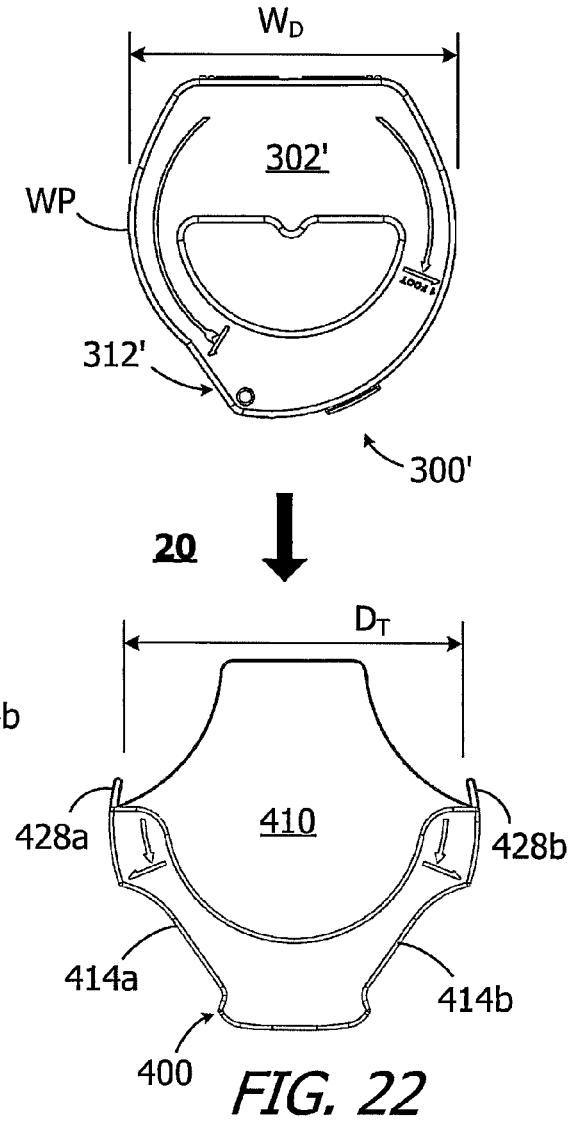
FIG. 22 is an exploded view of a support strap dispenser and holster system in accordance with one embodiment of a present invention.

Turning to FIGS. 22 and 23, a system 20 in accordance with the present invention includes a dispenser (e.g., dispenser 300'), with or without a rolled support strap carried therein, and a holster (e.g., holster 400). The exemplary support strap dispenser 300' and holster 400 are respectively sized and shaped such that the dispenser will fit snugly into the storage region 410 and the movable tabs 428*a* and 428*b* will keep the dispenser in the storage region until the user pulls the dispenser out of the holster. To that end, in exemplary system 20, the width $W_D$ of the dispenser housing 302' at its widest point is slightly greater (e.g., about 3-5 mm greater) than the distance $D_T$ between the free ends of the tabs 428*a* and 428*b*. As the dispenser 300' is pushed into the holster 400 through the insertion/removal opening 412 in the direction of the arrow (or the holster is pushed over the dispenser), the outer surface of the dispenser will push the tabs 428*a* and 428*b* apart when the widest point WP of the dispenser reaches the free ends of the tabs. The resiliency of the tabs 428*a* and 428*b* causes them to return to the position illustrated in FIG. 22 as the widest point WP passes the free ends and the dispenser 300' reaches the fully inserted position illustrated in FIGS. 23-25. Here, portions of the holster 400 will abut portions of the dispenser 300' above and below (in the illustrated orientation) the widest point WP, thereby trapping the dispenser in the storage region 410. The resilience of the tabs 428*a* and 428*b* is such that the dispenser 300' will not pop out of the holster during normal use, yet will allow the user to easily place the dispenser into the holster 400 and also remove the dispenser therefrom. It should also be noted that the distance between the front and rear walls 402 and 404 of the holster 400 is essentially equal to the thickness of the dispenser 300' in the illustrated implementation (note FIGS. 24 and 25).

Figure 24:
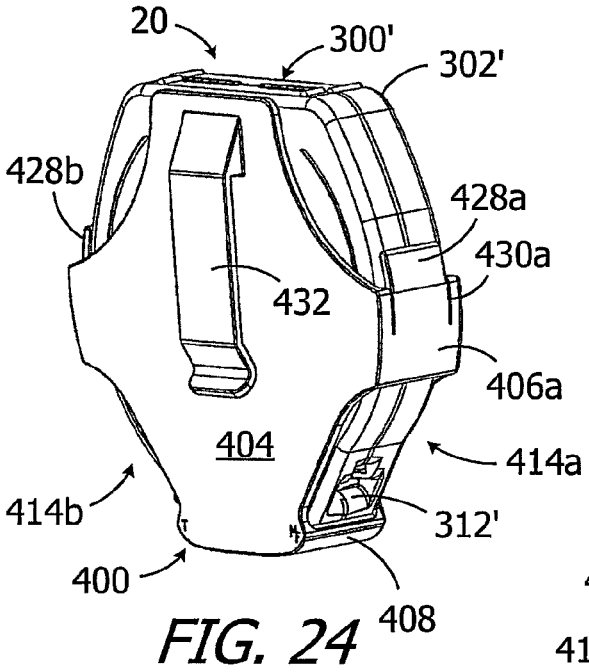
FIG. 24 is a perspective view of the system illustrated in FIG. 22.
Figure 25:
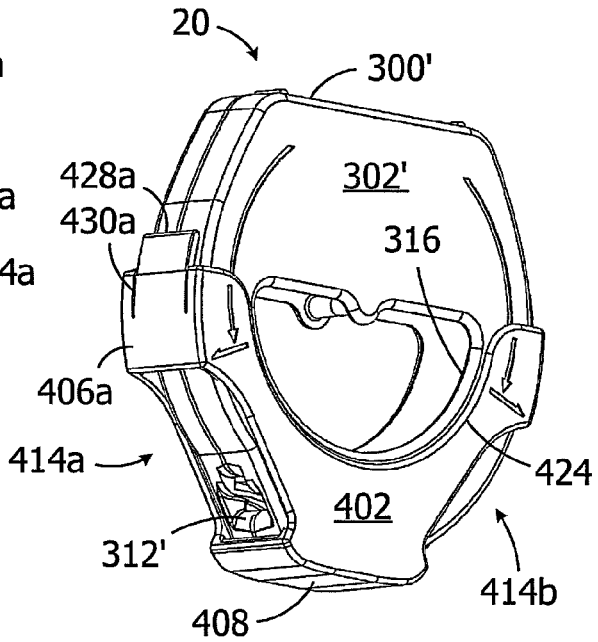
FIG. 25 is a perspective view of the system illustrated in FIG. 22.

As alluded to above, the respective configurations of the support strap dispenser 300' and holster 400 are such that the windows defined by the dispenser apertures 316 and 318 will be aligned with the holster front wall edge 424 in the manner illustrated in FIGS. 23-25 when the dispenser is fully inserted into the holster storage region 410. The dispenser storage region 310 will, therefore, be visible by way of the apertures 316 and 318 when the dispenser 300' is located within the holster 400. As best seen in FIGS. 24 and 25, the dispenser outlet 312' will be aligned with one of the outlet openings 414*a* and 414*b* (outlet opening 414*a* in the illustrated orientation) when the dispenser 300' is fully inserted into the holster 400. In addition, the positions of the edges 416*a*-422*a* that define opening 414*a* and the positions of the edges 416*b*-422*b* that define opening 414*b* (note FIGS. 18 and 20) in the illustrated implementation are located such that the dispenser outlet 312' protrudes though the outlet opening that the outlet is aligned with when the dispenser 300' is fully inserted into the holster 400.

The holster 400, and/or the associated dispenser 300', may also be mechanically keyed or otherwise configured to prevent rotation of the dispenser relative to the holster as lengths of support strap 200 are pulled from the dispenser. In the illustrated implementation, the holster 400 includes a peg or other projection 434 (FIG. 20) on the bottom wall 408 and the dispenser 300' includes an aperture 388 (FIG. 21). The projection 434 will enter the aperture 388 when the dispenser 300' is in the fully inserted position illustrated in FIGS. 23-25, thereby preventing rotation of the dispenser. The projection 434 is also centered on the bottom wall 408 such that it will be aligned with the aperture 388 regardless of the orientation (i.e., the FIG. 26 orientation or the FIG. 27 orientation) of the dispenser 300'. In other implementations, the locations of the projection and the aperture may be reversed, and other anti-rotation keying arrangements may be employed.

Figure 26:
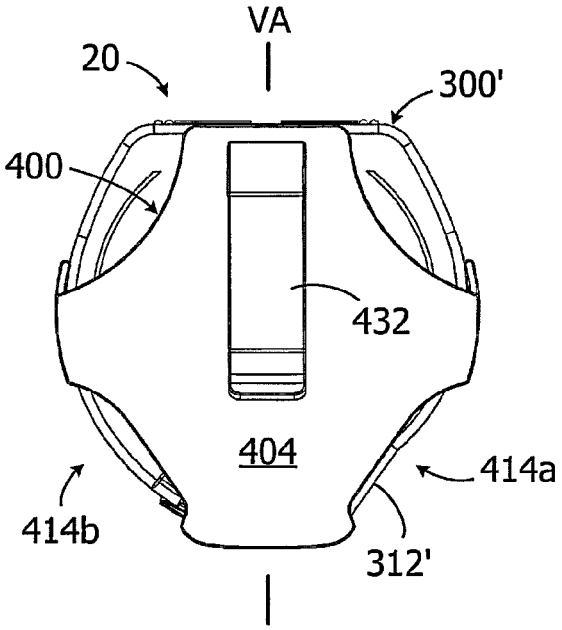
FIG. 26 is a rear view of the system illustrated in FIG. 22.
Figure 27:
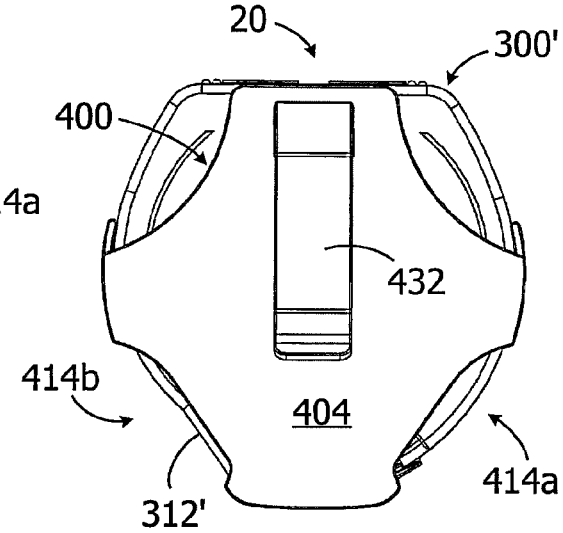
FIG. 27 is a rear view of the system illustrated in FIG. 22 with the orientation of the support strap dispenser reversed as compared to claim 26.

Turning to FIGS. 26 and 27, the respective configurations of the support strap dispenser 300' and the holster 400 are such that the orientation of the dispenser may be reversed. The holster 400 is symmetric about its vertical axis VA. Regardless of orientation, the dispenser outlet 312' will be aligned with one of the outlet openings 414*a* and 414*b*, one of the window-defining dispenser apertures 316 and 318 will be aligned with the holster front wall edge 424, and the holster projection 434 will be located in the dispenser aperture 388. Orientation of the dispenser 300' and the holster 400 relative to one another in the manner illustrated in FIG. 26 facilitates placement of the system 20 on, for example, the user's left hip. So positioned, the outlet 312' will face forwardly so that the user can conveniently pull strap through the outlet with his/her left hand and cut the strap with a cutting instrument in his/her right hand. Alternatively, when the dispenser 300' and the holster 400 are oriented relative to one another in the manner illustrated in FIG. 27, the system 20 may be placed on, for example, the user's right hip. So positioned, the outlet 312' will face forwardly so that the user can conveniently pull strap through the outlet with his/her right hand and cut the strap with a cutting instrument in his/her left hand. In both of these instances, the mounting of the dispenser 300' in the holster 400 onto the user (by way of a belt, tool belt, etc.) eliminates need for the user to hold the dispenser with one hand while pulling support strap with the other.

Figure 28:
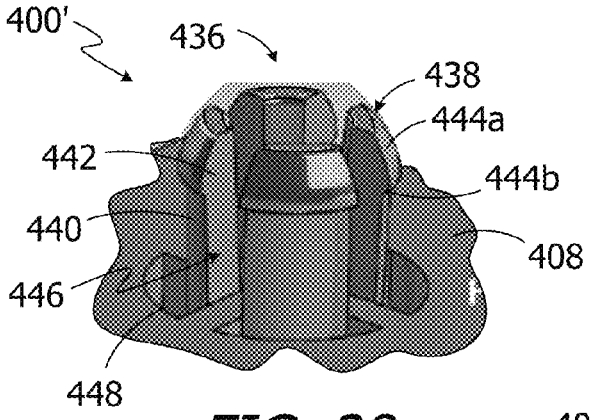
FIG. 28 is a top perspective view of a holster latch in accordance with one embodiment of a present invention.
Figure 29:
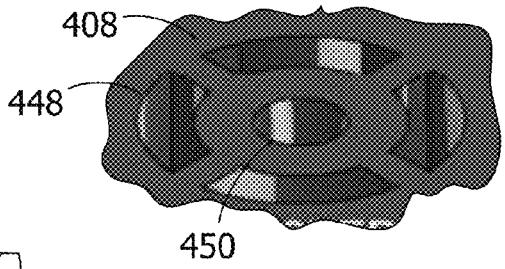
FIG. 29 is a bottom perspective view of the latch illustrated in FIG. 28.

Turning to FIGS. 28 and 29, the holster 400', which is essentially identical to holster 400 in structure, function, materials and operating methodology, may include a latch 436 in place of the projection 434 in holster 400. The exemplary latch 436 includes one or more latch members 438, and there are four latch members 438 in the illustrated embodiment. Each latch member 438 includes a deflectable (or "pivotable") post 440 and a head 442 with first and second cam surfaces 444*a* and 444*b*. There is also a gap 446 between each adjacent pair of latch members 438, an aperture 448 adjacent to each latch member 438 that extends though the bottom wall 408, and a central aperture 450.

Figure 30:
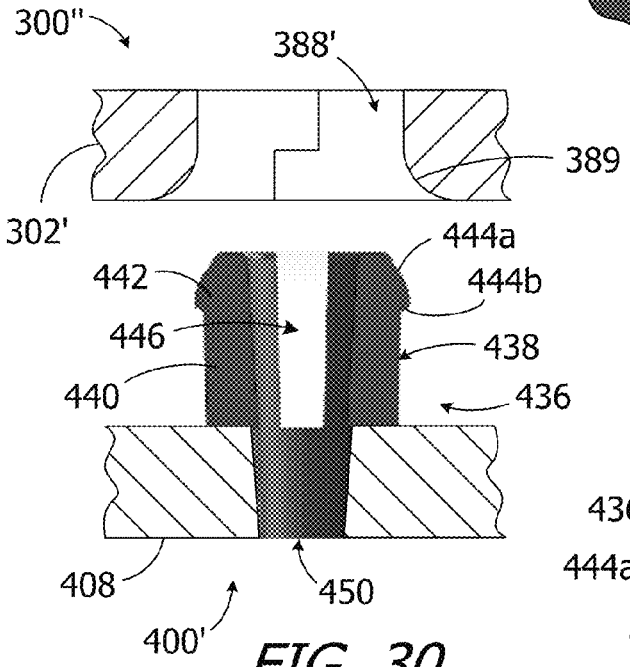
FIG. 30 is a section view showing the latch illustrated FIGS. 28 and 29 and a portion of a dispenser prior to latching.
Figure 31:
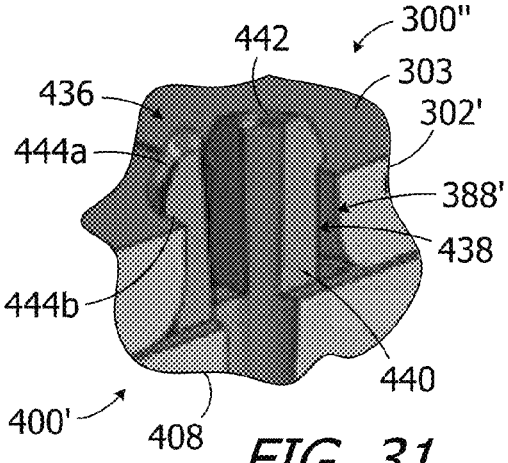
FIG. 31 is a section view showing the latch illustrated FIGS. 28 and 29 and a portion of a dispenser after latching.

The holster 400' may be used in conjunction with a support strap dispenser 300" that is essentially identical to support strap dispenser 300' in structure, function, materials and operating methodology. Here, however, the aperture 388 (FIG. 21) is replaced by the aperture 388' illustrated in FIGS. 30 and 31. The aperture 388' includes a tapered surface 389 which is configured to interact with the latch member cam surfaces 444*a*.

The holster latch 436 may be secured to the dispenser 300" as follows. The dispenser 300" and holster 400' will approach one another (FIG. 30) until the cam surfaces 444*a* engage the tapered surface 389. Continued movement will cause the latch member posts 440 to deflect inwardly, and out of their rest state, so that the latch member heads 442 can pass through the aperture 388'. The latch member posts 440 will remain in the inwardly deflected state until the heads 442 pass completely through the aperture 388'. At this point, the latch member posts 440 will pivot back to their rest state and the cam surfaces 444*b* will rest against an inner surface 303 of the housing 302', thereby latching the dispenser 300" to the holster 400'. This results in a more secure dispenser/holster connection than that associated with the projection 434. The cam surfaces 444*b* will cause the latch member posts 440 to deflect inwardly, thereby releasing the latch 436, when the dispenser 300' pulled out of the holster 400' by the user.

Although the present inventions have been described in terms of the preferred embodiments above, numerous modifications and/or additions to the above-described preferred embodiments would be readily apparent to one skilled in the art. By way of example, but not limitation, the present inventions include assemblies that comprise a support strap dispenser as described above in combination with a support strap roll located in the internal storage region of the support strap dispenser. The dispensers described above may also be used in conjunction with wire, adhesive painter's tape and other dispensable objects that are stored in roll form and, in at least some instances, cut to length as they are consumed. The present inventions also include assemblies that comprise a holster as described above or claimed below in combination with a dispenser that dispenses wire, adhesive painter's tape and other dispensable objects that are stored in roll form and, in at least some instances, cut to length as they are consumed. It is intended that the scope of the present inventions extends to all such modifications and/or additions.

I claim:

1. A holster for use with a support strap dispenser having an aperture and an outlet, the holster comprising:

a front wall, a rear wall, first and second side walls that extend from the front wall to the rear wall, and a bottom wall that extends from the front wall to the rear wall that together define a storage region for the support strap dispenser and at least one outlet opening which the dispenser outlet will be aligned with when the dispenser is in the storage region;

a latch on the bottom wall that extends into the storage region and is configured to engage the aperture and prevent rotation of the support strap dispenser relative to the holster as the support strap is pulled from the dispenser; and a retainer that maintains the dispenser in the storage region.

2. A holster as claimed in claim 1, wherein the at least one outlet opening comprises first and second outlet openings.

3. A holster as claimed in claim 2, wherein the holster defines a vertical axis and is symmetric about the vertical axis.

4. A holster as claimed in claim 1, further comprising:

a resilient clip on the rear wall.

5. A holster as claimed in claim 1, wherein the retainer comprises first and second movable tabs.

6. A holster as claimed in claim 5, wherein the first and second movable tabs are respectively mounted on the first and second side walls.

7. A holster as claimed in claim 1, wherein the latch comprises a plurality of deflectable latch members.

8. A system, the dispenser comprising:

a support strap dispenser including a housing with an internal storage region configured to store a support strap roll, an aperture and a dispenser outlet; and a holster including a front wall, a rear wall, first and second side walls that extend from the front wall to the rear wall, and a bottom wall that extends from the front wall to the rear wall that together define a storage region for the support strap dispenser and at least one outlet opening which the dispenser outlet will be aligned with when the support strap dispenser is in the storage region, a latch on the bottom wall that extends into the storage region such that the latch will be located within the aperture when the support strap dispenser is within the storage region, and a retainer that maintains the support strap dispenser in the storage region.

9. A system as claimed in claim 8, wherein the holster includes a resilient clip on the rear wall.

10. A system as claimed in claim 8, wherein the first and second movable tabs define respective free ends that are separated from one another by a distance; and the support strap dispenser defines a maximum width that is greater than the distance between the free ends of the movable tabs.

11. A system as claimed in claim 8, further comprising:

a support strap roll located within the support strap dispenser.

12. A system as claimed in claim 8, wherein the latch comprises a plurality of deflectable latch members.

13. A system as claimed in claim 8, wherein the at least one outlet opening comprises first and second outlet openings; and the respective configurations of the support strap dispenser and the holster are such that the dispenser outlet will be aligned with the first outlet opening when the support strap dispenser is within the storage region in a first orientation, and the dispenser outlet will be aligned with the second outlet opening when the support strap dispenser is within the storage region in a second orientation.

14. A system as claimed in claim 13, wherein the holster defines a vertical axis and is symmetric about the vertical axis.

15. A system as claimed in claim 8, wherein the retainer comprises first and second movable tabs.

16. A holster as claimed in claim 15, wherein the first and second movable tabs are respectively mounted on the first and second side walls.

17. A system, the dispenser comprising:

a support strap dispenser including a housing with an internal storage region configured to store a support strap roll, an aperture and a dispenser outlet; and a holster including a front wall, a rear wall, first and side walls that extend from the front wall to the rear wall, and a bottom wall that extends from the front wall to the rear wall that together define a storage region for the support strap dispenser and at least one outlet opening which the dispenser outlet will be aligned with when the support strap dispenser is in the storage region, a projection on the bottom wall that extends into the storage region such that the projection will be located within the aperture when the support strap dispenser is within the storage region, and a retainer that maintains the support strap dispenser in the storage region.

18. A system as claimed in claim 17, wherein the at least one outlet opening comprises first and second outlet openings; and the respective configurations of the support strap dispenser and the holster are such that the dispenser outlet will be aligned with the first outlet opening when the support strap dispenser is within the storage region in a first orientation, and the dispenser outlet will be aligned with the second outlet opening when the support strap dispenser is within the storage region in a second orientation.

* * * * *